US007093572B2

(12) United States Patent
Hendriksma et al.

(10) Patent No.: US 7,093,572 B2
(45) Date of Patent: Aug. 22, 2006

(54) ROLLER FINGER FOLLOWER ASSEMBLY FOR VALVE DEACTIVATION

(75) Inventors: Nick J. Hendriksma, Grand Rapids, MI (US); Timothy W. Kunz, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 373 days.

(21) Appl. No.: 10/742,316

(22) Filed: Dec. 19, 2003

(65) Prior Publication Data

US 2005/0132989 A1 Jun. 23, 2005

(51) Int. Cl.
*F01L 1/34* (2006.01)

(52) U.S. Cl. ..... 123/90.16; 123/90.15; 123/90.39; 74/569

(58) Field of Classification Search .. 123/90.15–90.18, 123/90.24–90.27, 90.39–90.59; 74/53–55, 74/567, 569

See application file for complete search history.

(56) References Cited

U.S. PATENT DOCUMENTS 5,544,626 A 8/1996 Diggs et al.
5,619,958 A * 4/1997 Hampton et al. ..... 123/90.16
6,314,928 B1 * 11/2001 Baraszu et al. ..... 123/90.16
6,532,920 B1 3/2003 Sweetnam et al.
6,755,167 B1 6/2004 Krieg et al.
6,925,978 B1 8/2005 Gerzseny et al.

* cited by examiner

*Primary Examiner*—Thomas Denion
*Assistant Examiner*—Jaime Corrigan
(74) *Attorney, Agent, or Firm*—Patrick M. Griffin

(57) ABSTRACT

A roller finger follower rocker arm assembly for deactivating an engine valve. A follower body pivots on a hydraulic lash adjuster, and engages a valve stem or lifter. The body receives a reciprocating member having a first and second rollers outboard of the body for following eccentrics of a cam lobe that straddles the body, the body having elongate openings on either side of the reciprocating member. A locking pin selectively locks and unlocks the body to the reciprocating member. The reciprocating member does not make contact with the cam lobe and functions only as a link between the latching mechanism and the rollers. The pin engages the reciprocating member by a latching spring and is disengaged by pressurized oil supplied through the hydraulic lash adjuster. Means is provided for limiting axial growth of the HLA during deactivation mode of the rocker arm assembly.

35 Claims, 6 Drawing Sheets

ROLLER FINGER FOLLOWER ASSEMBLY FOR VALVE DEACTIVATION

TECHNICAL FIELD

The present invention relates to mechanisms for altering the actuation of valves in internal combustion engines; more particularly, to finger follower type rocker arm assemblies having means for changing between normal and no valve lifts; and most particularly, to a two-step roller finger follower (RFF) assembly having a center reciprocating member disposed in a finger follower rocker arm body for reciprocating motion in the direction of lift between normal-lift and no-lift positions, and having a latching mechanism operative in an orthogonal bore in the finger follower body for latching and unlatching the reciprocating member to and from the finger follower body to shift between high lift and no lift modes, the latching mechanism being actuated by a latching spring and deactuated by engine oil supplied through a hydraulic lash adjuster.

BACKGROUND OF THE INVENTION

Variable valve activation mechanisms for internal combustion engines are well known. It is known to lower the lift, or even to provide no lift at all, of one or more valves of a multiple-cylinder engine during periods of light engine load. Such deactivation can substantially improve fuel efficiency.

Various approaches have been disclosed for changing the lift of valves in a running engine. One known approach is to provide a deactivation mechanism within the hydraulic lash adjuster (HLA) upon which a cam follower rocker arm pivots. Such an arrangement is advantageous in that it can provide variable lift from a single cam lobe by making the HLA either competent or incompetent to transfer the motion of the cam eccentric to the valve stem. A shortcoming of providing deactivation directly by the HLA is that because the cam lobe actuates the rocker near its longitudinal center point, the variation in lift produced at the valve-actuating end can be only about one-half of the extent of travel of the HLA deactivation mechanism.

Another known approach is to provide a deactivation mechanism in the roller finger follower itself, such as that disclosed in U.S. Pat. No. 6,604,498. In the mechanism disclosed, a two-part roller axle serves to selectively latch and delatch the roller from the body of the follower. The actuating mechanism needed to operate the deactivation mechanism resides adjacent one side of the roller finger follower body to act against an end of the two-part roller axle. For that reason, the mechanism occupies a substantial amount of space and can be cumbersome.

What is needed is a compact valve activation mechanism contained within a roller finger follower that is capable of deactivating an associated valve resulting in zero lift of the associated valve.

SUMMARY OF THE INVENTION

Briefly described, a roller finger follower rocker arm assembly in accordance with the invention includes a follower body having a socket at a first end for engaging a conventional hydraulic lash adjuster as a pivot means, and having a pad at a second and opposite end for engaging a valve stem or lifter means. A passage through the follower body in the direction of actuation by an engine camshaft is slidingly receivable of a reciprocating member. A transverse bore in the reciprocating member intersects elongate slots in the body on either side of the member. A shaft defining an axle is rotatably supported in the bore of the reciprocating member and extends through the bore and the slots in the body. First and second rollers are attached to the axle shaft outboard of the body for following identical first and second laterally-disposed eccentric portions of a cam lobe that straddle the body. The reciprocating member, axle shaft, bearings, and rollers define a center member sub-assembly. A base circle central portion of the cam lobe extends axially across the body between the eccentric portions. A latching mechanism selectively locks the body to the center member sub-assembly such that the entire follower follows the motion of the eccentric portions of the cam lobe. The reciprocating member itself does not make contact with the cam lobe and functions only as a link between the latching mechanism and the rollers. Preferably, the latching mechanism is lockingly engaged into the reciprocating member by a latching spring and is disengaged from the reciprocating member by the force of pressurized oil, controllably supplied through a passage from the head of the hydraulic lash adjuster, which overcomes the latching spring. A lost motion spring disposed between the reciprocating member and the body urges the rollers of the center member sub-assembly into continuous contact with the eccentric portions of the cam lobe. When the latching mechanism is disengaged from the reciprocating member, as by interrupting the oil supply, the center member sub-assembly reciprocates within the follower body as the rollers continue to follow the eccentric portions of the cam lobes in lost motion. Means is provided for limiting axial growth of the HLA during deactivation mode of the rocker arm assembly.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
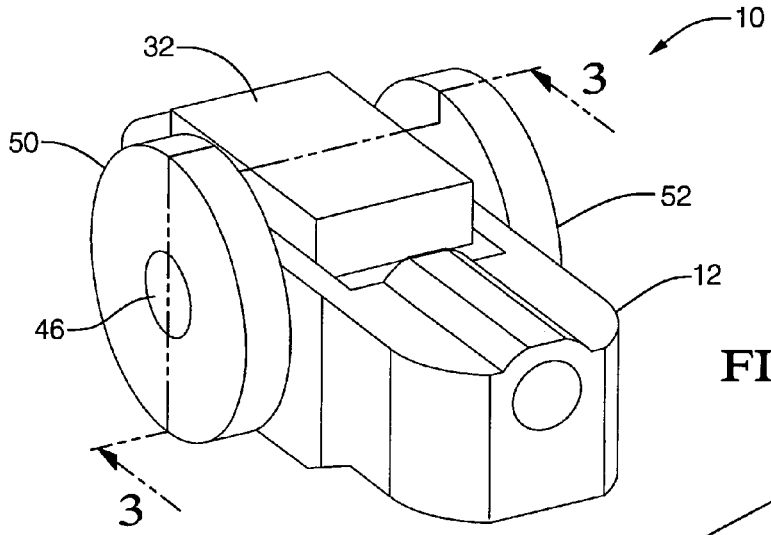
FIG. 1 is an isometric view of a first embodiment of a roller finger follower assembly for valve deactivation in accordance with the invention.

A roller finger follower assembly 10, 10' for valve deactivation in accordance with the invention includes a follower body 12 having a first end 14 having means for receiving the head of a hydraulic lash adjuster 16 for pivotably mounting assembly 10, 10' in an engine 18. The receiving means is preferably a spherical socket 20. A second and opposite end 22 of follower body 12 is provided with a pad 24, preferably arcuate, for interfacing with and actuating a valve stem 26 of an engine valve 27, such as a cylinder intake valve for engine 18. Body 12 is provided with a first passage 28 therethrough, passage 28 being generally cylindrical and having sliding surface 29 for slidably receiving a partially-cylindrical mating portion 30 of a reciprocating member 32 having a bore 34 transverse of passage 28. Passage 28 defines first and second body sidewalls 36,38. Sidewalls 36,38 are provided with flat bosses 40 on the outer surfaces, and elongated openings 42,44 are formed in the sidewalls and bosses. A shaft 46 defining an axle is rotatably supported in bore 34 as by needle bearings 48 and extends through both of openings 42,44. Follower rollers 50,52 are fixed onto axle shaft 46 on opposite ends thereof as, for example, by press fit. Taken together, reciprocating member 32, bearings 48, axle shaft 46, and rollers 50,52 define a center member sub-assembly 54 for variable engagement by and sliding within body 12.

Reciprocating member 32 further includes an head portion 56 extending toward first and second ends 14,22 of body 12 to define, respectively, a latching surface 58 and a spring seat 60. Second end 22 is provided with a well 62 for receiving a lost-motion spring 64 disposed between end 22 and spring seat 60.

Figure 6:
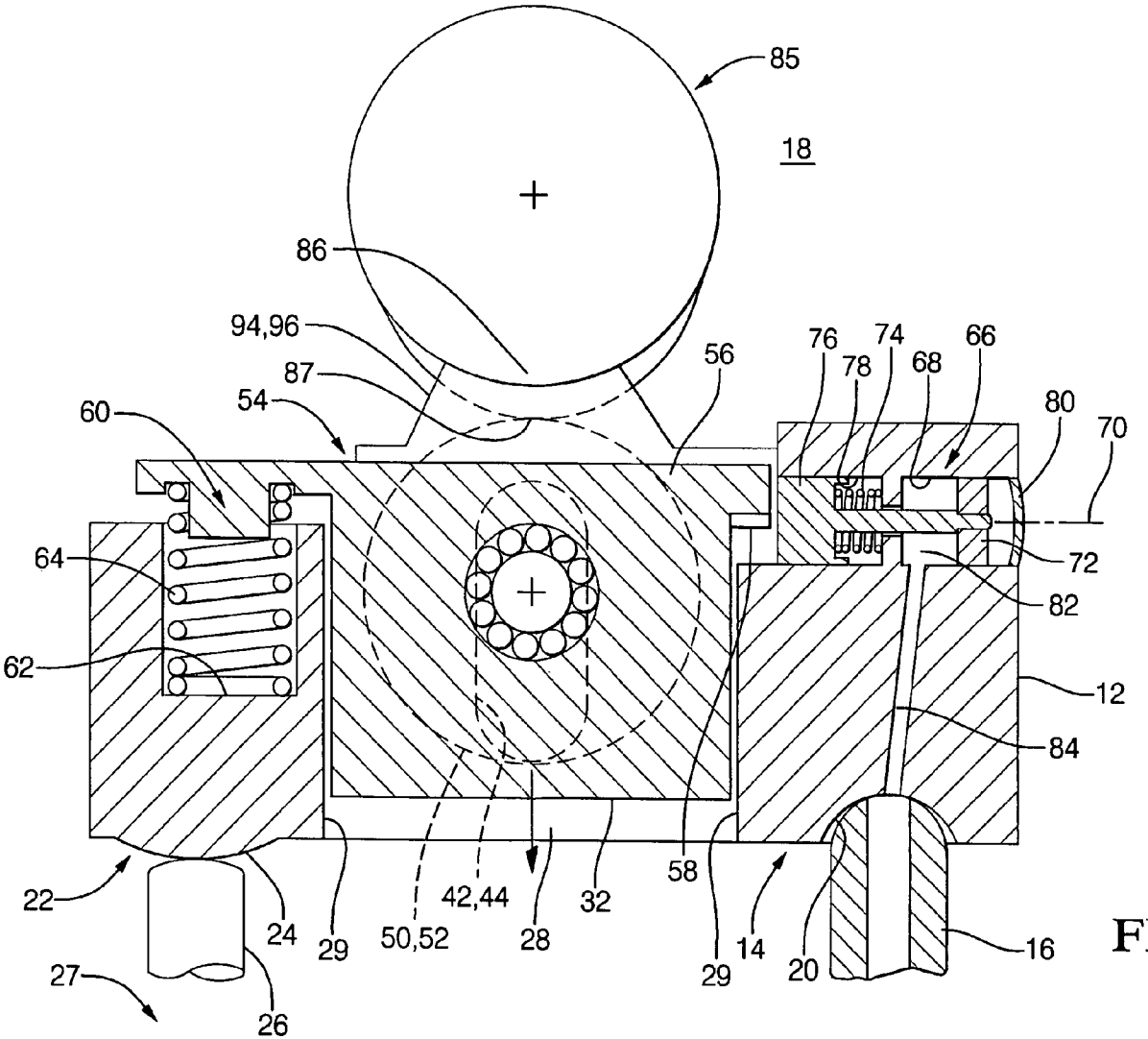
FIG. 6 is an elevational view in partial cross-section of the second embodiment shown in FIG. 4, showing the assembly in valve deactivation mode.

First end 14 is further provided with a latching mechanism 66, as best shown in FIG. 6, for engaging and locking reciprocating member 32 at its outward point of motion in passage 28. Mechanism 66 comprises a second bore 68 in body 12 and having an axis 70 intersecting passage 28, preferably orthogonally, bore 68 being preferably cylindrical.

Figure 4:
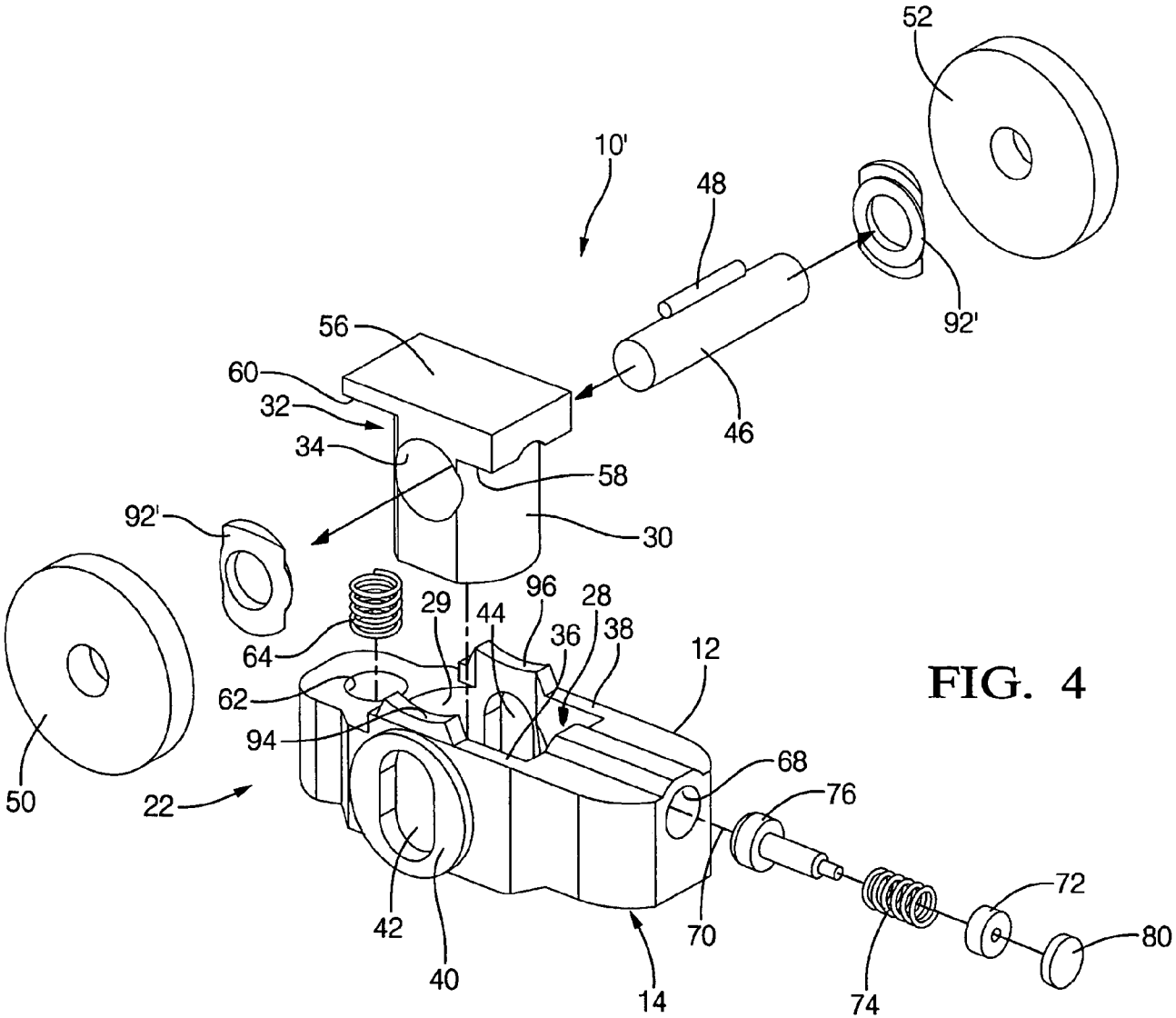
FIG. 4 is an exploded isometric view of a second embodiment of an assembly in accordance with the invention.
Figure 7:
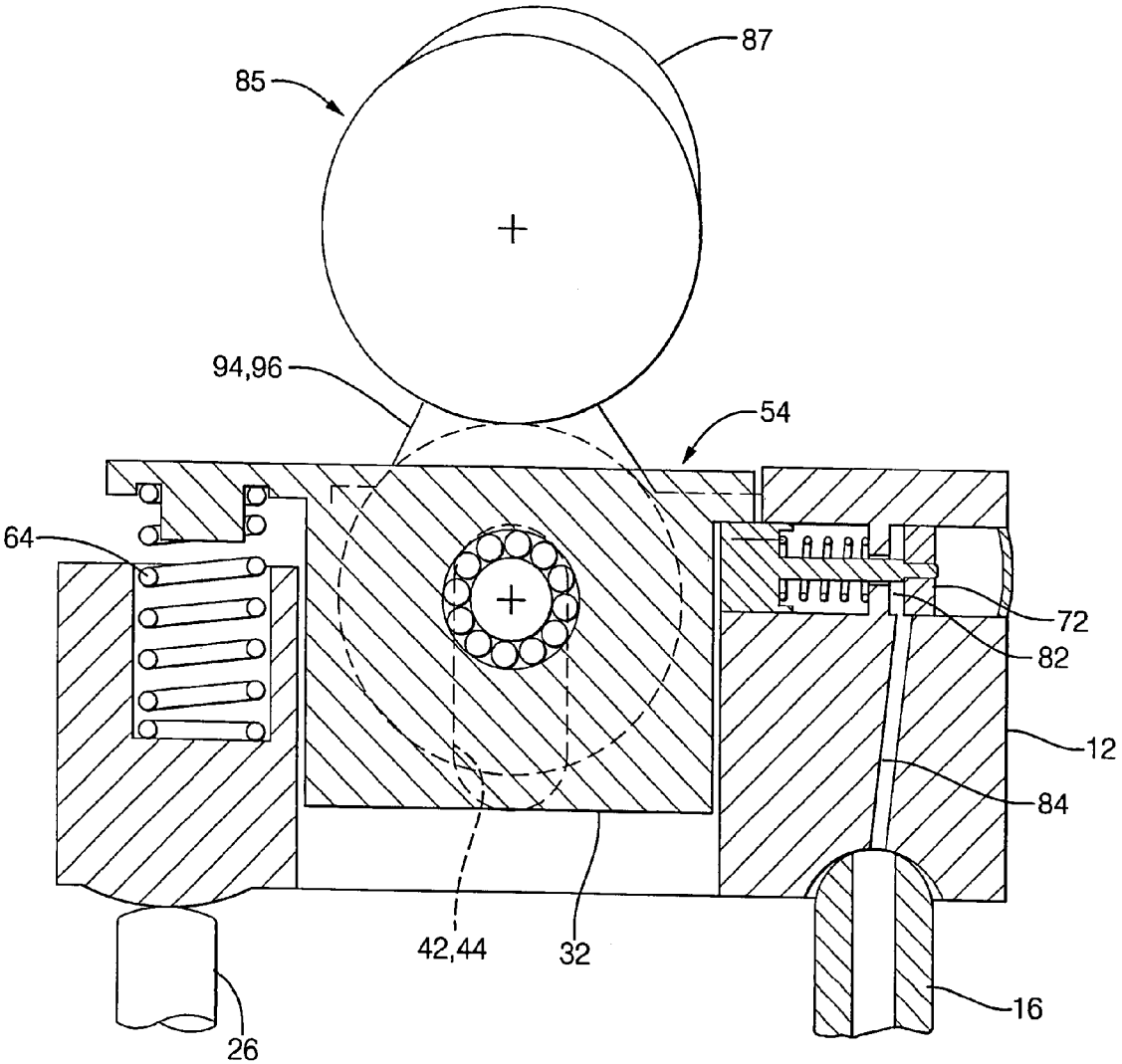
FIG. 7 is a view like that shown in FIG. 6, showing the assembly in valve activation mode.

Referring to FIGS. 4, 6, and 7, a valve train mechanism showing assembly embodiment 10' of the present invention, is shown. Latching mechanism 66 includes a piston 72 biased inwards in bore 68 by a latching spring 74 and extending toward reciprocating member 32 to support a latch member 76 which may slide along a slide surface 78 (FIG. 6) in body 12. Bore 68 is closed by a plug 80, forming a hydraulic chamber 82 in communication via passage 84 with socket 20. Pressurized oil may be supplied to chamber 82 from HLA 16, upon command from an engine control module (not shown), to cause piston 72 to become hydraulically biased away from reciprocating member 32. When such biasing occurs, to overcome the counter-bias of latching spring 74, latch member 76 is urged axially out of latching and locking engagement with latching surface 58. As shown in FIG. 6, when cam lobe 85 rotates to engage eccentric portions 87 with rollers 50,52 when the latching mechanism is unlatched, center member sub-assembly 54 follows in reciprocal motion but valve stem 26 is not activated and remains in a zero lift position.

Referring now to FIG. 7, when pressurized oil is no longer supplied to chamber 82 from HLA 16, upon command from an engine control module, piston 72 is no longer hydraulically biased away from reciprocating member 32. Latching spring 74 urges latch member 76 axially toward latching and locking engagement with latching surface 58. When cam lobe 85 rotates eccentric portions 87 out of engagement with rollers 50,52, the latching mechanism becomes latched causing center member sub-assembly 54 and body 12 to follow in reciprocal motion, pivoting about HLA 16, causing valve stem 26 to be activated to a normal high lift position.

Referring to FIGS. 3, 5, 6, and 7, central portion 86 of cam lobe 85 is flanked by first and second eccentric portions 87 (only one visible in FIGS. 6 and 7) for continuously engaging rollers 50,52, center member sub-assembly 54 being urged in the Z direction by lost motion spring 64. When the engine control module determines, in known fashion from various engine operating parameters, that a no-lift condition is desired, oil pressure above a switching threshold is supplied to chamber 82, overcoming spring 74 to bias piston 72 and associated latch member 76 away from reciprocating member 32, thereby unlatching latch member 76 such that reciprocating member 32 is again free to slide in passage 28. When the camshaft again rotates to place eccentrics portions 87 on rollers 50,52, reciprocating member 32 is depressed in lost motion into body 12, as shown in FIG. 6. As long as oil pressure is supplied to chamber 82, latching mechanism 66 remains disengaged from reciprocating member 32, and assembly 10 functions as a no-lift rocker.

While assemblies 10, 10' are in valve-deactivation mode, body 12 is ungrounded at the HLA end 14. Further, the HLA is under reduced axial load from the rocker arm assembly while simultaneously being supplied with high-pressure oil. Consequently, if body 12 is unconstrained, there will be a tendency for the HLA to expand axially, and any such expansion results in mis-positioning body 12, preventing later re-engagement with center member sub-assembly 54. Thus, it is important to prevent unconstrained growth of the HLA during valve deactivation mode. Two embodiments for preventing HLA growth are shown in FIG. 2 and in FIG. 4, respectively.

Figure 2:
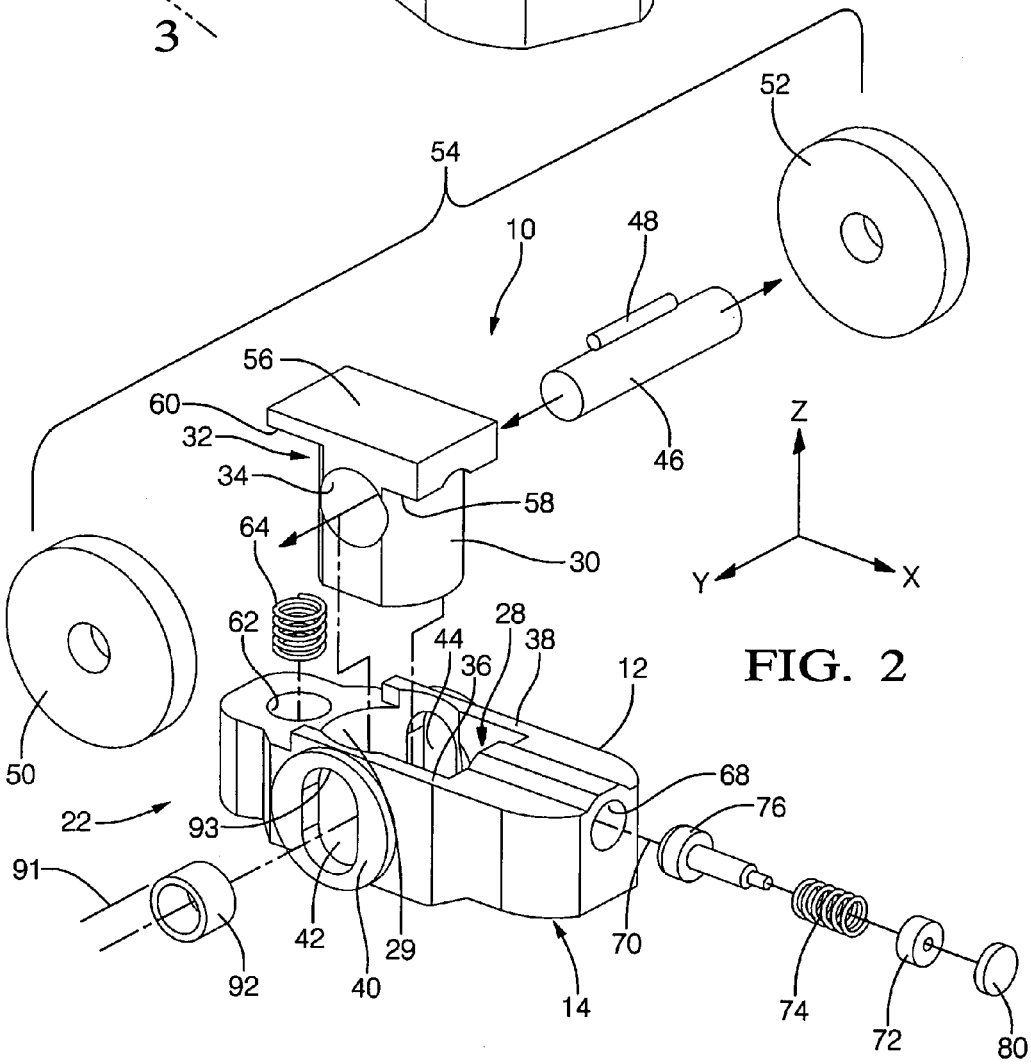
FIG. 2 is an exploded isometric view of the assembly shown in FIG. 1.
Figure 3:
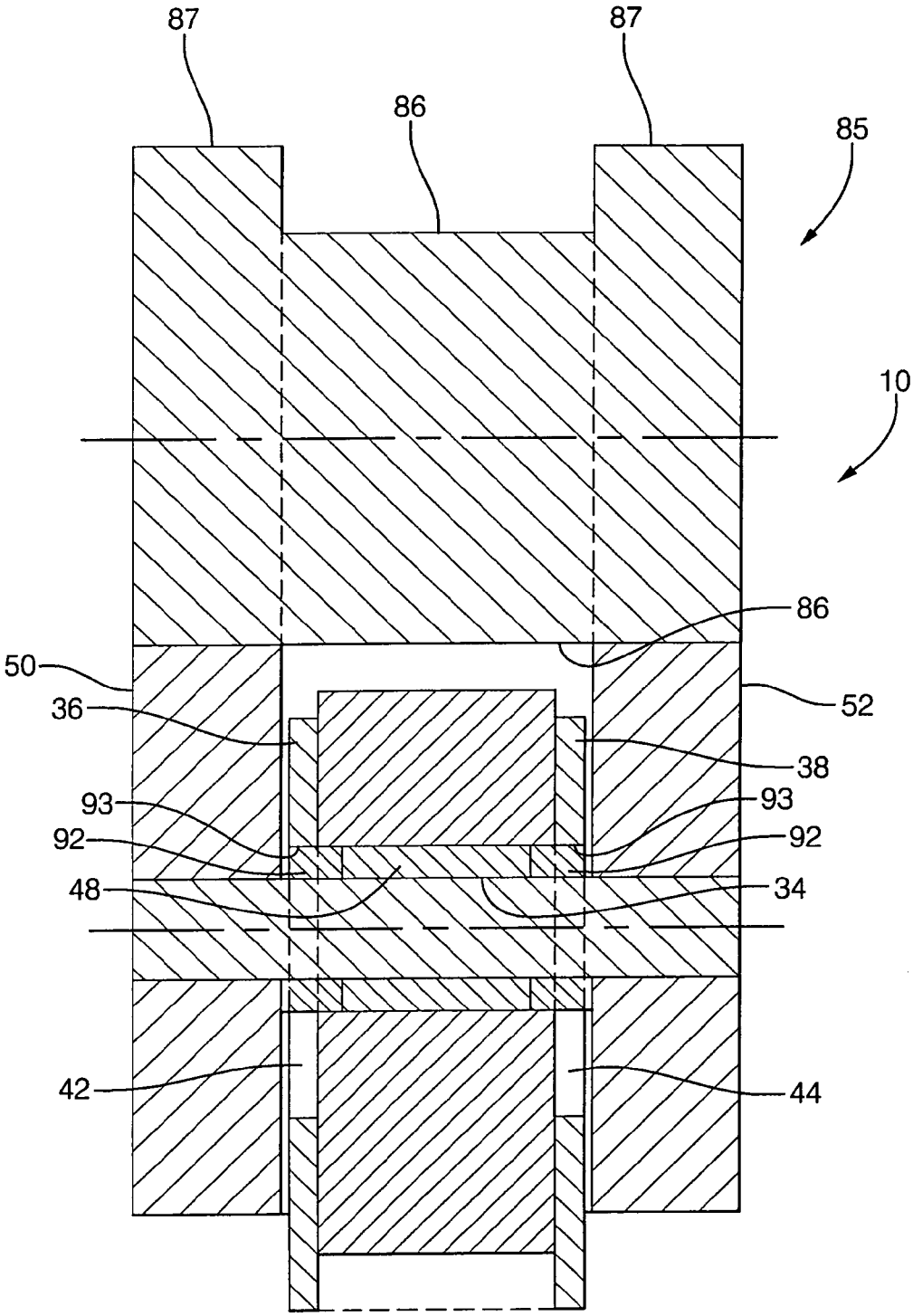
FIG. 3 is an elevational cross-sectional view taken along line 3—3 in FIG. 1, and further showing a cam lobe in accordance with the invention engaged with the assembly.

Referring to FIGS. 2 and 3, in embodiment 10, lifter body 12 is positioned laterally between rollers 50,52 and eccentric portions 87 of cam lobe 85 and thus would be unconstrained from being urged toward central portion 86 of cam lobe 85. It will be seen that lost motion spring 64 urges center member sub-assembly 54 and body 12 away from each other in the Z-axis direction (axes are defined in FIG. 2). Spacer bushings 92 (FIG. 2—only one is shown) of assembly 10 are pressed into each end of bore 34 outboard of needle bearings 48 and extend through elongated openings 42,44 in sidewalls 36,38 of body 12. The inner diameter of bushings 92 is selected to provide rotational clearance to shaft 46. Elongated openings 42,44 are formed to accommodate the outer diameter of bushings 92 and to limit rotational motion of reciprocating member 32 relative to body 12 about the Z axis. In operation, spring 64 urges reciprocating member 32 away from body 12 until bushings 92 engage the upper end 93 of elongated openings 42,44. Radius 91 (FIG. 2) of bushings 92 thus defines the Z-direction limit of separation of center member sub-assembly 54 and body 12. Because spring 64 is selected to be stronger than the expansive force of HLA 16, the position of body 12 is effectively grounded to the cam lobe surfaces through the center member sub-assembly, thus preventing growth of the HLA. It should be noted that, by selectively sizing bushing radius 91, the clearance gap or lash between latching surface 58 and latch member 76, when the mechanism is in its high-lift mode, can be carefully controlled during the assembly process. In this way, manufacturing tolerances of the roller finger follower assembly can be accommodated by matching bushing radius 91 to a particular assembly.

Figure 5:
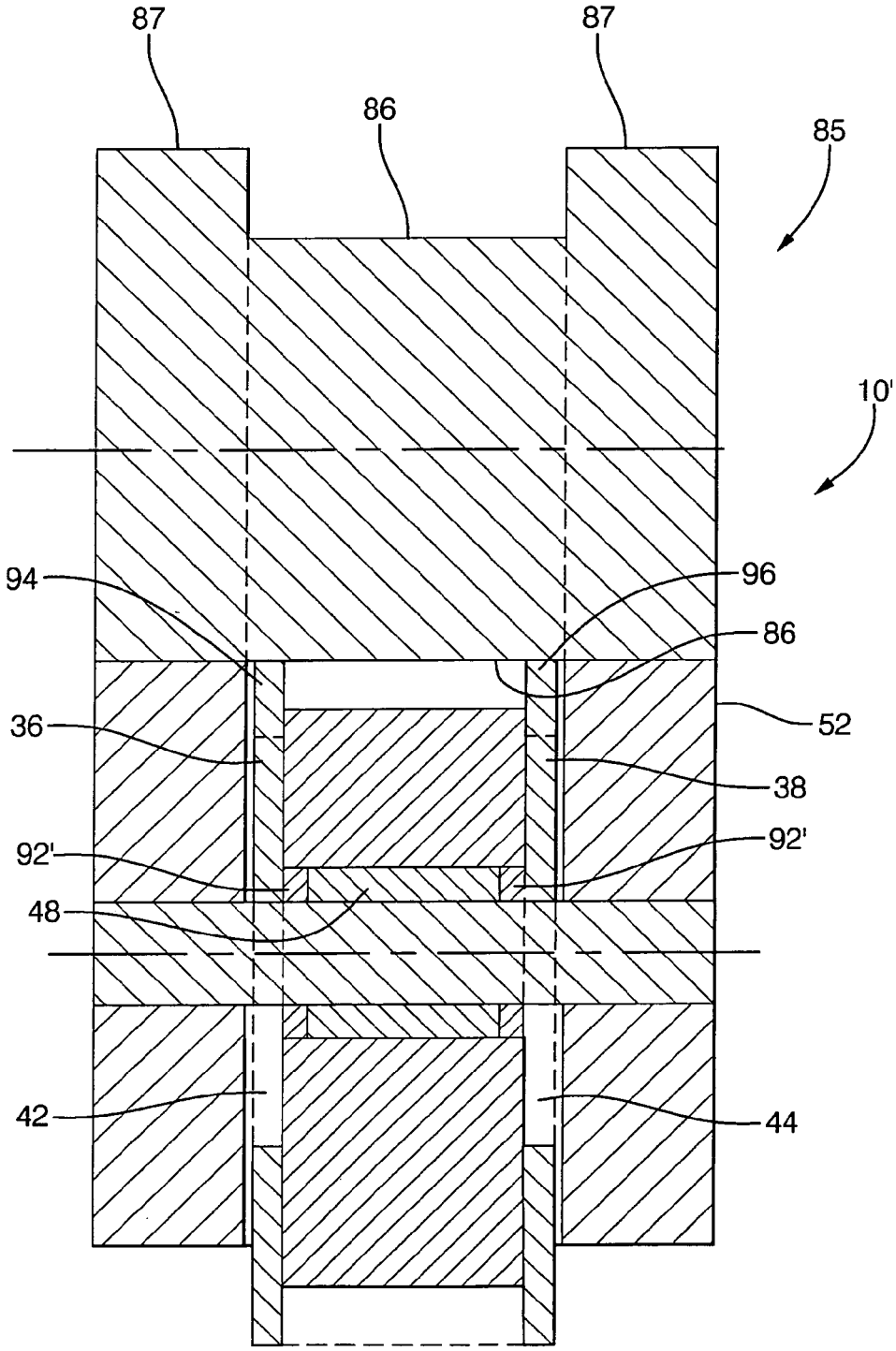
FIG. 5 is an elevational cross-sectional view similar to the view shown in FIG. 3, but of the second embodiment shown in FIG. 4.

Referring to FIGS. 4 and 5, in alternate embodiment 10', body 12 is grounded directly to cam lobe 85. In the rest position of rocker assembly 10', body extensions 94,96 of sidewalls 36,38 both engage central portion 86 of cam lobe 85 to limit directly the Z-direction growth of HLA 16. In embodiment 10', simple spacers 92' may be used to retain needle bearings 48 in place of bushings 92 without resort to their press fit into bore 34 as in embodiment 10, the elongated openings 42,44 having a width only sufficient to accommodate the diameter of shaft 46.

In the embodiments shown, latch member 76 is activated by supplying pressurized oil through oil passages internal to the body of the roller finger follower. It is understood that the present invention also contemplates that the latch member can be a simple spring-biased pin with an end portion protruding axially from body bore 68. An external actuator would act on the protruding end portion to move latch member 76 from a latched position to an unlatched position.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A roller finger follower rocker arm assembly for variably activating a gas valve in an internal combustion engine having a cam lobe having a central portion flanked by first and second outer portions, comprising:

a) a follower body having means for engaging an hydraulic lash adjuster of said engine at a first end of said body and having means for engaging said gas valve at a second end of said body and having a first passage formed in said body defining first and second sidewalls and having first and second elongated openings formed in said first and second sidewalls, respectively;

b) a member disposed in said first passage for movement relative to said follower body, said member having a transverse bore;

c) a shaft disposed in said bore and extending through said first and second elongated openings;

d) at least one roller disposed on said shaft for rotation outside said follower body for engaging at least one of said first and second outer portions of said cam lobe; and e) a latching mechanism disposed in said follower body for selectively latching and delatching said member to said body.

2. A rocker arm assembly in accordance with claim 1 further comprising a lost motion spring disposed between said member and said follower body.

3. A rocker arm assembly in accordance with claim 2 wherein said shaft is rotatably mounted in said transverse member bore as an axle for said at least one roller.

4. A rocker arm assembly in accordance with claim 3 further comprising bearing means disposed between said shaft and said member.

5. A rocker arm assembly in accordance with claim 2 wherein said hydraulic lash adjuster has an expansive force and wherein the spring force of said lost motion spring is greater than said lash adjuster expansive force.

6. A rocker arm assembly in accordance with claim 1 wherein said valve is a cylinder intake valve.

7. A rocker arm assembly in accordance with claim 1 further comprising means for limiting growth of said hydraulic lash adjuster during said deactivation mode.

8. A rocker arm assembly in accordance with claim 7 wherein said means for limiting comprises at least one extension on said follower body for engaging said central portion of said cam lobe.

9. A rocker arm assembly in accordance with claim 7 wherein said means for limiting comprises at least one bushing being fixed to said member and extending into at least one of said elongated openings in said body sidewall.

10. A rocker arm assembly in accordance with claim 1 wherein said latching mechanism is in communication with a pressurized oil and one of said latching and said delatching is carried out by providing said pressurized oil to said latching mechanism.

11. A rocker arm assembly in accordance with claim 10 wherein said latching mechanism further comprises:

a) a bore in said follower body interceptive of said member;

b) a piston disposed in said bore and defining a chamber adjacent thereto for receiving said pressurized oil for actuating said piston;

c) a latching member operatively connected to said piston for engaging to and disengaging from said member; and d) a biasing means disposed in said bore for actuating said latching member in opposite direction from said pressurized oil actuation when said oil pressure is reduced.

12. A roller finger follower rocker arm assembly for variably activating a gas valve in an internal combustion engine having a cam lobe having a central portion flanked by first and second outer portions, comprising:

a) a follower body having first and second ends, said first end being adapted to engage an hydraulic lash adjuster of said engine, said second end being adapted to engage said gas valve, said body having a first passage formed in said body defining first and second sidewalls, said body having first and second elongated openings formed in said first and second sidewalls, respectively;

b) a member disposed in said first passage for movement relative to said follower body, said member having a transverse bore;

c) a shaft disposed in said bore and extending through said first and second elongated openings;

d) at least one roller disposed on said shaft for rotation relative to said follower body for engaging at least one of said first and second outer portions of said cam lobe; and e) a latching mechanism disposed in said follower body for selectively latching and delatching said member to said body.

13. A rocker arm assembly in accordance with claim 12 wherein said at least one roller is disposed outside said follower body.

14. A rocker arm assembly in accordance with claim 12 further comprising a lost motion spring disposed between said member and said follower body.

15. A rocker arm assembly in accordance with claim 14 wherein said shaft is rotatably mounted in said transverse member bore as an axle for said at least one roller.

16. A rocker arm assembly in accordance with claim 15 further comprising a bearing disposed between said shaft and said member.

17. A rocker arm assembly in accordance with claim 14 wherein said hydraulic lash adjuster has an expansive force and wherein the spring force of said lost motion spring is greater than said lash adjuster expansive force.

18. A rocker arm assembly in accordance with claim 12 wherein said valve is a cylinder intake valve.

19. A rocker arm assembly in accordance with claim 12 further comprising at least one extension on said follower body for engaging said central portion of said cam lobe and for limiting growth of said hydraulic lash adjuster during said deactivation mode.

20. A rocker arm assembly in accordance with claim 12 further comprising at least one bushing being fixed to said member and extending into at least one of said elongated openings in said body sidewall for limiting growth of said hydraulic lash adjuster during said deactivation mode.

21. A rocker arm assembly in accordance with claim 12 wherein said latching mechanism is in communication with a pressurized oil and one of said latching and said delatching is carried out by providing said pressurized oil to said latching mechanism.

22. A rocker arm assembly in accordance with claim 21 wherein said latching mechanism further comprises:

a) a bore in said follower body interceptive of said member;

b) a piston disposed in said bore and defining a chamber adjacent thereto for receiving said pressurized oil for actuating said piston;

c) a latching member operatively connected to said piston for engaging to and disengaging from said member; and d) a spring disposed in said bore for actuating said latching member in opposite direction from said pressurized oil actuation when said oil pressure is reduced.

23. A roller finger follower rocker arm assembly for variably activating a gas valve in an internal combustion engine having a cam lobe having a central portion flanked by first and second eccentric portions, comprising:

a) a follower body having means for engaging an hydraulic lash adjuster of said engine at a first end of said body and having means for engaging said gas valve at a second end of said body and having a first passage formed in said body defining first and second sidewalls and having first and second elongated openings formed in said first and second sidewalls, respectively;

b) a reciprocating member slidably disposed in said first passage and having a transverse bore;

c) a shaft disposed in said bore and extending through said first and second elongated openings;

d) first and second rollers disposed on said shaft for rotation outside said follower body for engaging said first and second eccentric portions, respectively, of said cam lobe; and e) a latching mechanism disposed in said follower body for selectively latching said reciprocating member to said body to activate said gas valve in an activation mode and alternatively for delatching said reciprocating member from said body to deactivate said gas valve in a deactivation mode.

24. A rocker arm assembly in accordance with claim 1 further comprising a lost motion spring disposed between said reciprocating member and said follower body.

25. A rocker arm assembly in accordance with claim 24 wherein said shaft is rotatably mounted in said transverse reciprocating member bore as an axle for said rollers.

26. A rocker arm assembly in accordance with claim 25 further comprising bearing means disposed between said shaft and said reciprocating member.

27. A rocker arm assembly in accordance with claim 24 wherein said hydraulic lash adjuster has an expansive force and wherein the spring force of said lost motion spring is greater than said lash adjuster expansive force.

28. A rocker arm assembly in accordance with claim 1 wherein said valve is a cylinder intake valve.

29. A rocker arm assembly in accordance with claim 1 further comprising means for limiting growth of said hydraulic lash adjuster during said deactivation mode.

30. A rocker arm assembly in accordance with claim 29 wherein said means for limiting comprises at least one extension on said follower body for engaging said central portion of said cam lobe.

31. A rocker arm assembly in accordance with claim 29 wherein said means for limiting comprises at least one bushing being fixed to said reciprocating member and extending into at least one of said elongated openings in said body sidewall.

32. A rocker arm assembly in accordance with claim 1 wherein said latching mechanism is in communication with a pressurized oil and one of said latching and said delatching is carried out by providing said pressurized oil to said latching mechanism.

33. A rocker arm assembly in accordance with claim 32 wherein said latching mechanism further comprises:

a) a bore in said follower body interceptive of said reciprocating member;

b) a piston disposed in said bore and defining a chamber adjacent thereto for receiving said pressurized oil for actuating said piston;

c) a latching member operatively connected to said piston for engaging to and disengaging from said reciprocating member; and d) a biasing means disposed in said bore for actuating said latching member in opposite direction from said pressurized oil actuation when said oil pressure is reduced.

34. A multiple-cylinder internal combustion engine having a cam lobe having a central portion flanked by first and second lateral eccentric portions, the engine comprising a roller finger follower rocker arm assembly for variably activating a gas valve in the engine, wherein the rocker arm assembly includes a follower body having means for engaging a hydraulic lash adjuster of said engine at a first end of said body and having means for engaging said gas valve at a second end of said body and having a first passage formed in said body defining first and second sidewalls and having first and second elongated openings formed in said first and second sidewalls, respectively, a reciprocating member slidably disposed in said first passage and having a transverse bore, a shaft disposed in said bore and extending through said first and second elongated openings, first and second rollers disposed on said shaft for rotation outside said follower body for engaging said first and second lateral eccentric portions, respectively, of said cam lobe, and a latching mechanism disposed in said follower body for selectively latching said reciprocating member to said body to activate said gas valve in an activation mode and alternatively for delatching said reciprocating member from said body to deactivate said gas valve in a deactivation mode.

35. An engine in accordance with claim 34 wherein said latching mechanism is in communication with a pressurized oil in said hydraulic lash adjuster for selectively latching said reciprocating member to said body to activate said gas valve and alternatively for delatching said reciprocating member from said body to deactivate said gas valve, one of said latching and said delatching being carried out by providing said pressurized oil from said hydraulic lash adjuster.

* * * * *